US007469633B2

(12) United States Patent
Newsome, III

(10) Patent No.: US 7,469,633 B2
(45) Date of Patent: Dec. 30, 2008

(54) PIVOTALLY LOADED BALER SYSTEM

(75) Inventor: John L. Newsome, III, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 11/460,119

(22) Filed: Jul. 26, 2006

(65) Prior Publication Data

US 2008/0022865 A1 Jan. 31, 2008

(51) Int. Cl.
*B30B 15/30* (2006.01)

(52) U.S. Cl. ..... 100/215; 100/98 R; 100/245

(58) Field of Classification Search ..... 100/35, 100/39, 41, 49, 98 R, 99, 215, 240, 245; 241/285.3
See application file for complete search history.

(56) References Cited

U.S. PATENT DOCUMENTS

| | | | | |
|---|---|---|---|---|
| 1,812,797 | A | | 6/1931 | Lindemann |
| 2,622,748 | A | * | 12/1952 | Feidert ..... 414/525.6 |
| 2,984,174 | A | | 5/1961 | Jones |
| 3,518,078 | A | * | 6/1970 | Chazen ..... 75/414 |
| 3,827,349 | A | | 8/1974 | Gilman |
| 4,018,169 | A | | 4/1977 | Schmalz |
| 4,149,457 | A | | 4/1979 | Smith |
| 4,205,604 | A | | 6/1980 | Ashley |
| 4,289,068 | A | | 9/1981 | Heinrich |
| 4,464,987 | A | | 8/1984 | Heinrich |
| 5,551,336 | A | * | 9/1996 | Griffin et al. ..... 100/353 |
| 5,823,105 | A | | 10/1998 | Feldman |

FOREIGN PATENT DOCUMENTS

| | | |
|---|---|---|
| CH | 577 379 | 7/1976 |
| DE | 296 04 644 | 7/1997 |

OTHER PUBLICATIONS

The International Search Report for PCT Application No. PCT/US2007/072776; Filed Jul. 3, 2007; Date of Completion Nov. 15, 2007; Date of Mailing Nov. 22, 2007.
Written Opinion for PCT Application No. PCT/US2007/072776; Filed Jul. 3, 2007; Date of Completion Nov. 15, 2007; Date of Mailing Nov. 22, 2007.

* cited by examiner

*Primary Examiner*—Jimmy T Nguyen
(74) *Attorney, Agent, or Firm*—Alston & Bird LLP

(57) ABSTRACT

A pivotally loaded baler system includes a ram, which ram is movable along a horizontal axis, and a housing disposed at least partially about the ram. A pivotable loading member or tube is connected to the housing such that, when the loading member or tube is pivoted to a vertical disposition, a defined loading chute or the loading tube surrounds a vertical axis and an open end of the chute or tube aligns with a loading aperture of the housing. As the loading member or tube is pivoted to the vertical disposition, material is permitted to fall toward the loading aperture. A cutting edge of the ram severs material as the ram extends. Severed upper portions of the material are surrounded by the loading chute or tube and are at least temporarily supported from below by the ram.

5 Claims, 3 Drawing Sheets

PIVOTALLY LOADED BALER SYSTEM

FIELD OF THE INVENTION

Embodiments of the present invention relate generally to baler systems for crushing and baling materials. More particularly, embodiments of the invention relate to a pivotally loaded baler system for severing and baling long members of material.

BACKGROUND OF THE INVENTION

The recycling of cardboard is practiced in many industries. For example, large retailers typically have baler systems for crushing and baling cardboard boxes so that cardboard used in product packaging can be conveniently volumetrically reduced, stored, and transported to recycling centers or otherwise disposed. Long members constructed of cardboard, such as tubular cores of textile and paper rolls, represent a special challenge in situations where only a typical cardboard-baling system is available. For example, the tubular cores often have elongate dimensions that will not fit within a typical baler system configured for baling boxes.

Therefore, a need exists for improvements toward volumetrically reducing and baling long members of material. A need exists for a baler system that receives whole elongate members of material and produces conveniently sized bales of the material. A need exists for a baler system that severs and crushes long cardboard cores.

BRIEF SUMMARY OF THE INVENTION

Aspects of the invention may address at least some of the above needs and achieve other advantages. For example, a first aspect of the invention relates to a pivotally loaded baler system having a ram movable along a horizontal axis, a housing disposed at least partially about the ram, a fixed member connected to the housing, and a loading member that is pivotable from a generally horizontal disposition to a vertical disposition. When the loading member is disposed in the vertical disposition, a vertical loading chute is defined at least in part by the loading member and the fixed member. The vertical loading chute surrounds a vertical axis and has an open lower end aligned with the loading aperture of the housing. In at least one embodiment according to this first aspect of the invention, a pair of side walls are disposed along opposite respective sides of the loading member. In that embodiment, when the loading member is disposed in the vertical disposition, the vertical loading chute is defined by the loading member, the pair of side walls, and the fixed member. For example, the side walls may be connected to and may pivot with the loading member.

Furthermore, in at least one embodiment according to this first aspect of the invention, the ram includes a cutting edge and the housing includes a shear blade. The ram is capable of severing material between the cutting edge and the shear blade as the ram moves from a withdrawn position to an extended position. As long members of material are severed, upper portions thereof remain above the loading aperture and are surrounded by the vertical loading chute. The upper portions are at least temporarily supported from below by the ram.

A second aspect of the invention relates to a pivotally loaded baler system having a ram movable along a horizontal axis, a housing disposed at least partially about the ram, and a loading tube that is pivotable from a horizontal disposition to a vertical disposition. When the loading tube is disposed in the vertical disposition, the loading tube surrounds a vertical axis and an open end of the loading tube aligns with a loading aperture defined by the housing. In at least one embodiment according to this second aspect of the invention, the loading tube defines a polygonal cylinder, and has a rectangular cross section. Furthermore, in at least one embodiment according to this second aspect, the baler system includes a sensor capable of providing a signal indicating whether the loading tube does or does not contain material.

A third aspect of the invention relates to a method of loading a baler. The method includes the steps of disposing material onto a pivotable loading member having a disposition that is at least partially horizontal as the material is disposed thereon, and pivoting the loading member to a vertical disposition such that the material falls toward a loading aperture of the baler. A vertical loading chute surrounding a vertical axis is defined at least in part by the loading member when the loading member is pivoted to the vertical disposition. In at least one embodiment according to this third aspect of the invention, disposing material onto the loading member is accomplished at least in part by passing the material into a pivotable loading tube. In that embodiment, the loading tube is pivoted to a vertical disposition and defines the vertical loading chute. In at least one other embodiment, the method includes passing material between a pair of side walls disposed along opposite respective sides of the loading member and pivoting the loading member toward a fixed member of the baler such that the vertical loading chute is defined by the loading member, the pair or side walls, and the fixed member. The side walls may be connected to and may pivot with the loading member.

BRIEF DESCRIPTION OF THE SEVERAL VIEWS OF THE DRAWINGS

Figures 1, 2, 3:
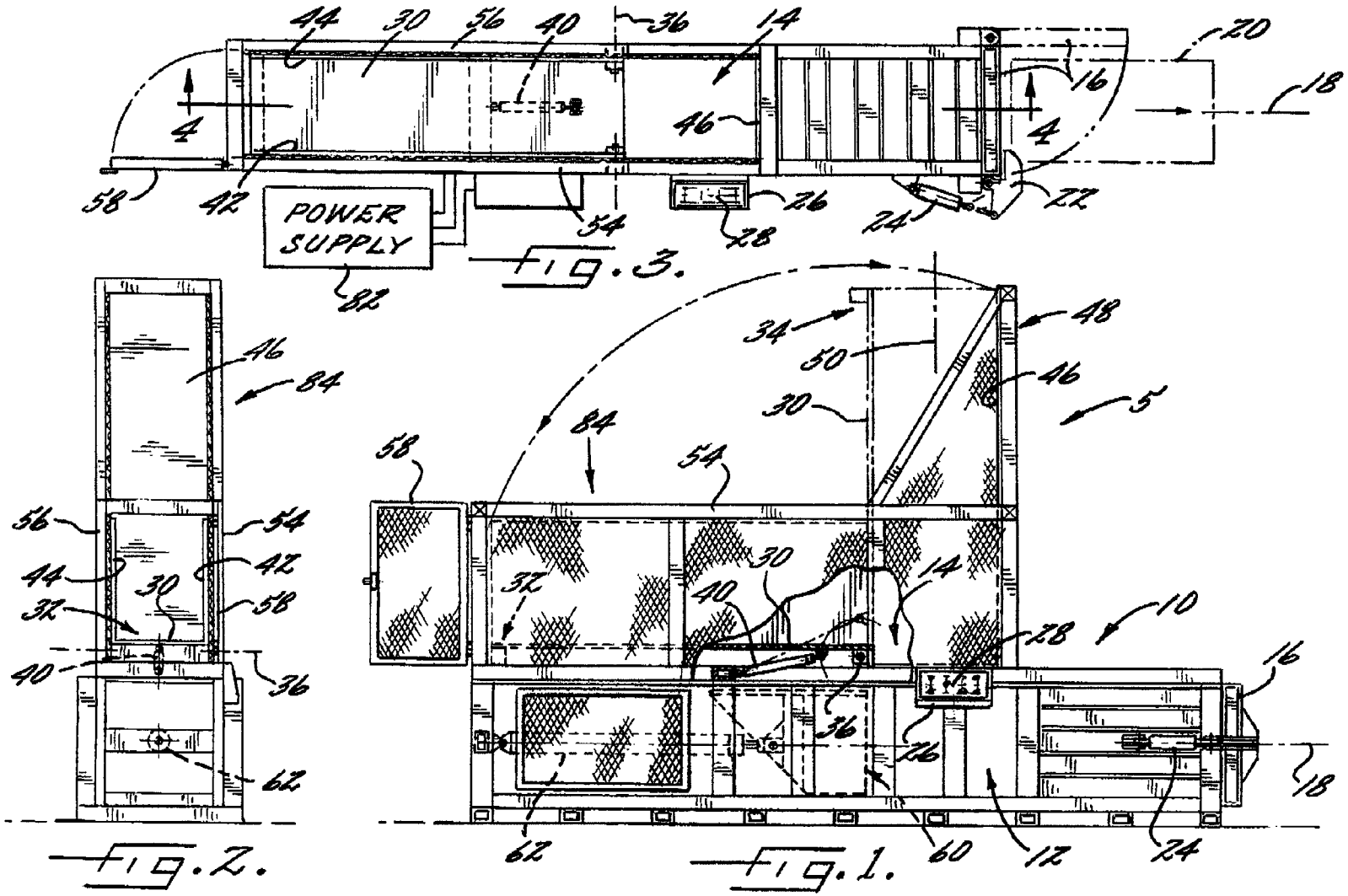
Figure 4A:
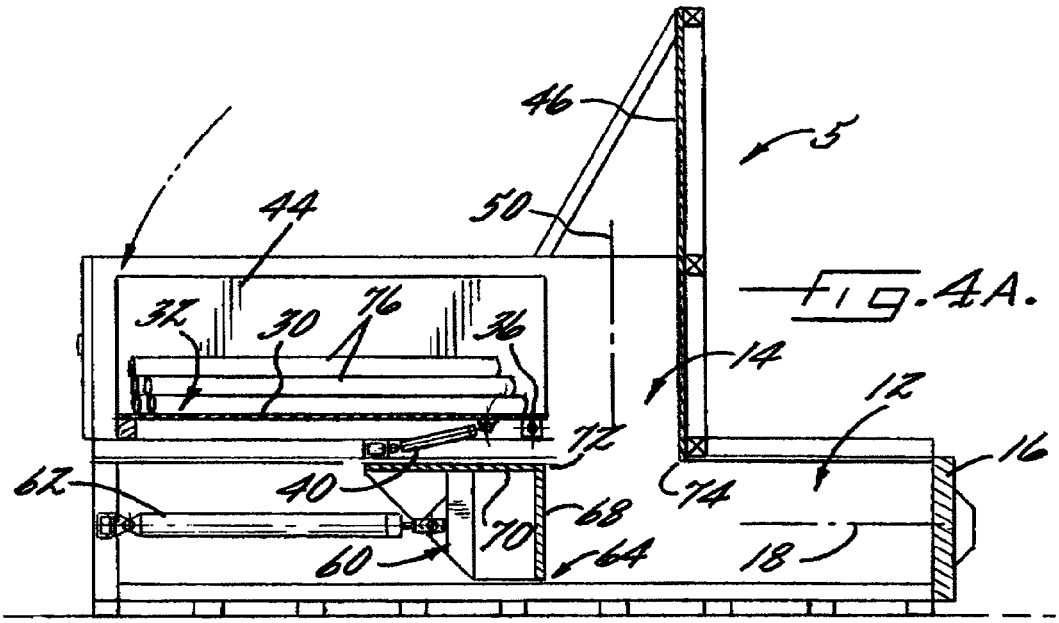
Figure 4B:
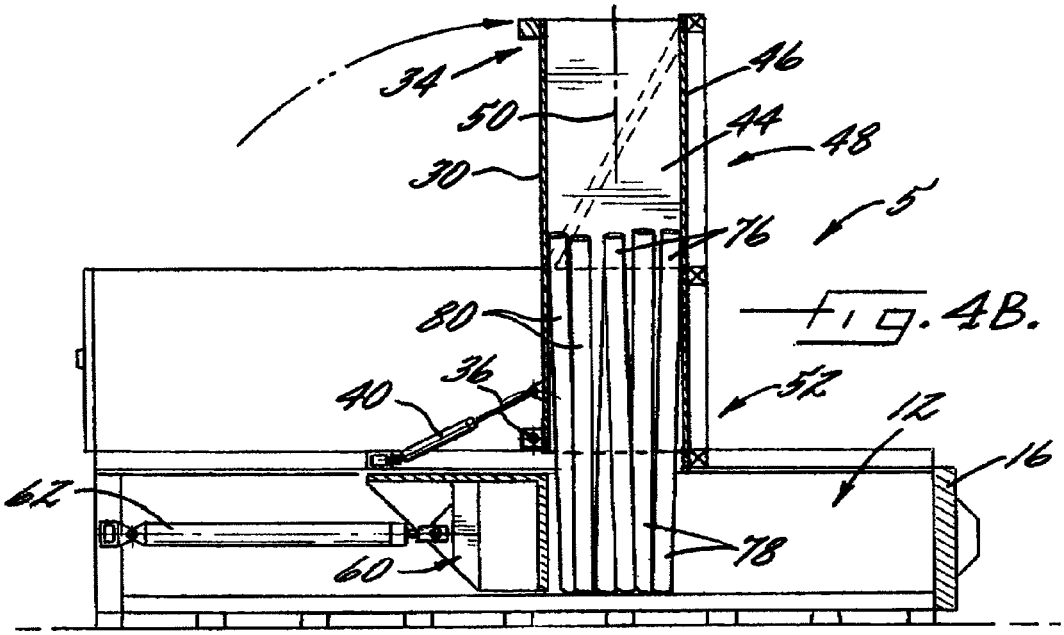
Figure 4C:
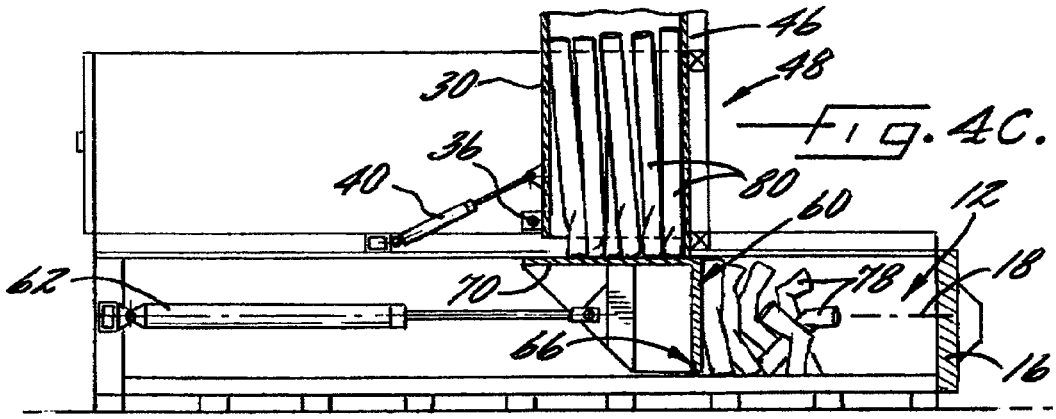

Having thus described the invention in general terms, reference will now be made to the accompanying drawings, which are not necessarily drawn to scale, and wherein:

FIG. 1 is a frontal elevation view of a pivotally loaded baler system according to at least one embodiment of the present invention, shown with a loading member pivotable from a horizontal disposition to a vertical disposition;

FIG. 2 is a side elevation view of the baler system of FIG. 1, shown with the loading member disposed for receiving material destined for baling;

FIG. 3 is a plan view of the baler system of FIG. 1, shown with an exit door that permits a bale of crushed material to exit the baler system;

FIG. 4A is a cross-sectional view of the baler system of FIG. 1, taken upon the plane indicated by the line 4 in FIG. 1, shown with material destined for baling placed on the horizontally disposed loading member;

FIG. 4B is a cross-sectional view of the baler system of FIG. 1, taken upon the plane indicated by the line 4 in FIG. 1, shown with the loading member pivoted to a vertical disposition and the material partially entered into the housing of the baler system; and FIG. 4C is a cross-sectional view of the baler system of FIG. 1, taken upon the plane indicated by the line 4 in FIG. 1, shown with a ram disposed at an extended position and the material severed by the ram.

Figure 5:
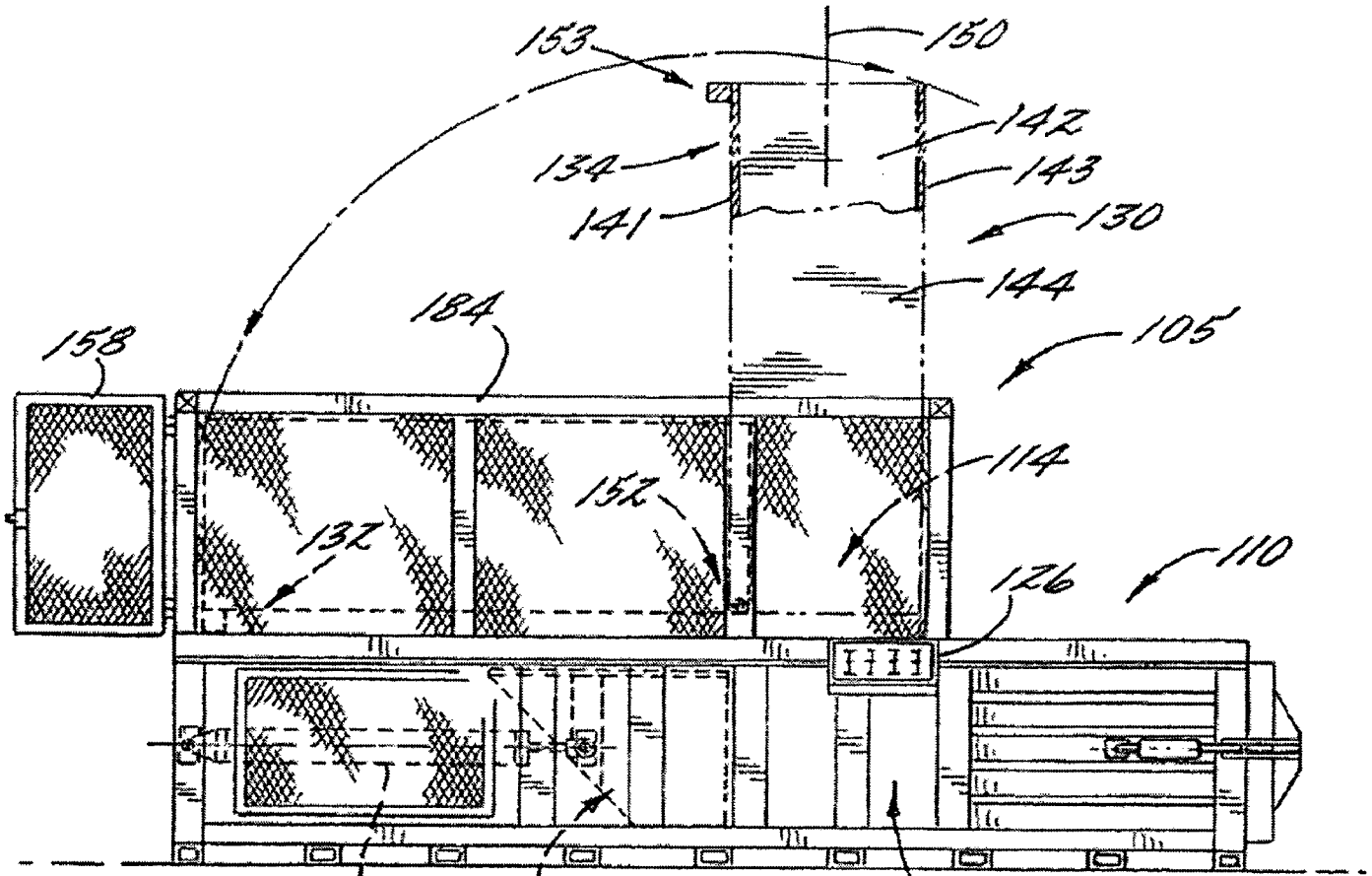

FIG. 5 is a frontal elevation view of a pivotally loaded baler system according to at least one other embodiment of the present invention, shown with a loading tube pivotable from a horizontal disposition to a vertical disposition.

DETAILED DESCRIPTION OF THE INVENTION

The present invention now will be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

An embodiment of a pivotally loaded baler system 5 is illustrated in FIGS. 1-3. The baler system 5 includes a housing 10 that defines a charge box 12 into which material can be loaded and in which the loaded material can be crushed and baled. Material enters the charge box 12 through a loading aperture 14 (FIG. 4A) defined in an upper portion of the housing. An exit door 16 remains closed and prevents material from escaping the housing as the material is crushed by a ram that is movable within the housing along a horizontal longitudinal axis 18. When an amount of crushed material is accumulated within the charge box, the exit door is opened to permit the crushed material 20 (FIG. 2) to exit the housing. Optionally, the crushed material can be wrapped with baling wire in order to prevent expansion of the material and to facilitate convenient transportation of the material as a bale. The baler system 5 includes a latch 22 motivated by an actuator 24 to either prevent or permit opening of the exit door 16 depending on the disposition of the latch. The operations of the baler system 5 are directed by way of a control system 26 comprising a number of control switches 28. For example, the disposition of the actuator 24 is controlled by the control system 26. Thus latching and releasing of the door 16 are effected by the control system responsively to one or more user actions, such as the pressing of a control switch, at the control system. In at least one other embodiment however, a pivotally loaded baler system includes a manually operated latch for preventing and permitting the opening of an exit door without a motorized or powered actuator.

A loading member 30 is pivotally connected to the housing 10 for loading material into the charge box through the loading aperture 14. As shown in FIG. 1, the loading member is pivotable from a horizontal disposition 32 to a vertical disposition 34. The loading member is shown in horizontal disposition in FIGS. 3, and 4A. The loading member is shown in the vertical disposition in FIGS. 4B, and 4C. The loading member pivots about a horizontal pivot axis 36 that is perpendicular to and disposed above the horizontal longitudinal axis 18. Material 76 destined to be baled is placed on the loading member when the loading member is in the horizontal disposition as shown in FIG. 4A. The loading member is then pivoted to the vertical disposition as shown in FIG. 4B to permit the material to fall toward the loading aperture. The loading member 30 is motivated by an actuator 40 to assume the horizontal and vertical dispositions. The actuator 40 disposes the loading member in the horizontal and vertical dispositions responsively to one or more user actions, such as the pressing of a control switch, at the control system. The loading member 30 motivated by the actuator 40 is optionally capable of lifting hundreds of pounds of material from the horizontal disposition to the vertical disposition.

Lateral side walls 42 and 44, which are at least partially vertically disposed, are connected to the loading member along opposing sides of the loading member to assist in preventing materials destined for baling from spilling laterally from the loading member as the loading member is pivoted from the horizontal disposition 32 to the vertical disposition 34. The side walls pivot with the loading member when the loading member is pivoted about the horizontal pivot axis 36.

A fixed member 46, which is at least partially vertically disposed, is connected to the housing 10 adjacent an edge of the loading aperture 14 to assist in guiding material destined for baling toward the loading aperture and charge box as the loading member is pivoted from the horizontal disposition to the vertical disposition. When the loading member is disposed in the vertical disposition, the loading member 30, the fixed member 46, and the lateral side walls 42 and 44 define a vertical loading chute 48 (FIG. 4B) that surrounds a vertical axis 50 and has an open lower end 52 aligned with the loading aperture. Thus, when material destined for baling is loaded onto the loading member, and the loading member is pivoted to the vertical disposition, the material is prevented from spilling from the baler system 5 by the vertical loading chute 48 and is permitted to fall toward the charge box through the open lower end 52 of the loading chute.

Lateral cage members 54 and 56 are connected to the housing 10 along opposing sides of the housing and at least partially surround the loading member for the safety of operators. For example, an operator standing proximal the control system 26 is prevented by the cage members from being injured by the pivoting loading tube.

A safety door 58 pivotally connected to the lateral cage member 56 can be manually opened to allow passage of material between the lateral cage members when the loading member is disposed in the horizontal disposition. The safety door is manually closed when the loading member is to be pivoted toward the vertical disposition. The safety door may be automatically locked closed when the loading member is not disposed in the horizontal disposition in order to prevent injuries. Furthermore, movements of the baler system, such as the pivoting movements of the loading member 30 and horizontal movements of the ram within the housing 10, may be automatically arrested when the safety door is open. A micro-switch may be mounted on safety, either lateral cage member, or housing to send an electrical signal to the control system 26 for indicating the disposition of the safety door.

The safety door 58, the fixed member 46, and the lateral cage members 54 and 56 define a cage 84 that surrounds the loading member and the loading aperture 14 when the safety door is closed. The cage optionally extends vertically from the housing to any desired height and may assist in preventing material destined for baling from spilling from the baler system. For example, in at least one embodiment of a baler system according to the present invention, a loading member pivots to a vertical disposition such that a vertical loading chute is defined by the loading member and fixed members or cage members without regard to whether lateral side walls are connected to and pivot with the loading member.

The loading member 30, the lateral side walls 42 and 44, and the fixed member 46 can be constructed from planar sheets of durable material and may include supportive frame members. For example, they can be formed of steel plates, aluminum plates, other metals, sheets of rigid thermoplastic material, hardwood boards, and plywood. They may include rigid frame members such as steel, iron, or aluminum materials formed as tubing or channel members. Their surfaces facing the interior of the loading chute 48 are optionally smooth to permit materials destined for baling to fall freely toward the loading aperture 14 when the loading member is disposed in the vertical disposition. One or more of the lateral side walls and the fixed member 46 may define a viewing window that conveniently allows viewing into the area above the loading aperture by a user standing near the control system. A transparent panel constructed of wire-reinforced glass, thermoplastic, or metal fence material may mounted in the viewing window to prevent lateral spillage of material from the area above the loading aperture. The lateral cage members 54 and 56 and the safety door 58 can be constructed of fence material supported by rigid members, such as mesh or lattice metal fence material supported by steel truss members. These descriptions of particular materials by which particular structures and members may by constructed are provided merely as examples and cannot be construed as limiting in any way.

As shown in FIGS. 4A, 4B, and 4C, the baler system 5 includes a ram 60 that is movable horizontally along the longitudinal axis 18 within the charge box 12. An actuator 62 motivates the ram 60 to move between a withdrawn position 64 (FIGS. 4A and 4B) and an extended position 66 (FIG. 4C). The ram includes an abutting surface 68, an upper surface 70, and a cutting edge 72 defined along the junction of the abutting surface 68 and upper surface 70. A cutting edge 74 of the housing is defined along or adjacent an edge of the loading aperture 14. The cutting edge 74 of the housing 10 opposes the cutting edge 72 of the ram as the ram moves from the withdrawn position to the extended position. The ram is capable of severing material disposed between the cutting edge 72 and the cutting edge 74 as the ram moves from the withdrawn position to the extended position. Such movement entails the passage of the cutting edge of the ram closely by the cutting edge of the housing causing material disposed between the cutting edges to be severed by shear forces. Respective shear blades or other cutting members may be fixedly or removably attached to the cutting edge of the ram and the cutting edge of the housing to facilitate the severing of material.

The loading of material into the charge box of the pivotally loaded baler system 5 and the crushing of the loaded material may be understood in view of these descriptions with reference to FIGS. 4A, 4B, and 4C that illustrate stages of a typical baling session. Advantages and benefits according to the present invention are provided by the pivotally loaded baler system 5 toward the baling of long members of material such as tubular cardboard cores. Therefore, although other materials having other configurations can be baled by the baler system 5, FIGS. 4A, 4B, and 4C are described herein in the context of the baling of long tubular material members 76 made of cardboard.

A typical baling session of the pivotally loaded baler system 5 begins with the loading member 30 disposed in the horizontal disposition 32 and with the ram 60 at the withdrawn position 64, as shown in FIG. 4A wherein material members 76 have been passed between the side walls and 42 (FIG. 2) and 44 and placed onto the loading member. These descriptions relate equally to situations wherein the material members have been placed manually on the loading member and to situations wherein the material members have been placed by automotive means such as by use of a fork lift, crane, or conveyor.

The typical baling session of FIG. 4A continues in FIG. 4B wherein the actuator 40 has disposed the loading member from the horizontal disposition to the vertical disposition responsively to one or more user actions, such as the pressing of a control switch, at the control system. As the loading member is pivoted from the horizontal disposition toward the vertical disposition, the loading member permits the material members 76 to fall by the force of gravity toward the loading aperture 14 of the housing 10. In FIG. 4B, the ram 60 is disposed at the withdrawn position 64 and permits the material members 76 to at least partially enter the charge box through the loading aperture. In the illustrated typical baling session of FIGS. 4A, 4B, and 4C, the material members 76 are too long to enter the charge box as whole members. Thus, the material members partially enter the charge box in FIG. 4B through the loading aperture. Lower portions 78 of the material members enter the charge box while upper portions 80 of the material members remain above the loading aperture. The upper portions 80 of the material members are surrounded by the vertical loading chute 48 in FIG. 4B. Thus, the material members 76 are prevented from spilling from the baler system 5 when the loading member is disposed in the vertical disposition such that the vertical loading chute is defined surrounding the vertical axis 50.

The typical baling session of FIGS. 4A and 4B continues in FIG. 4C wherein the actuator 62 has forcibly positioned the ram 60 into the extended position 66 responsively to one or more user actions, such as the pressing of a control switch, at the control system. As the ram is moved from the withdrawn position toward the extended position, the ram severs the material members into separate lower portions 78 and upper portions 80. The severed upper portions 80 remain at least temporarily above the loading aperture within the vertical loading chute 48 and are at least temporarily supported from below by the upper surface 70 of the ram as the ram continues its motion beyond the cutting edge 74 of the housing. The severed lower portions are disposed within the charge box and are subjected to crushing forces between the abutting surface 68 of the ram and the exit door 16 of the baler system.

The baling session of FIGS. 4A, 4B, and 4C may continue with the ram reciprocating between the withdrawn position and the extended position. With each return to the withdrawn position, the ram permits further entry of material member portions into the charge box through the loading aperture. With each extension toward the extended position, the ram severs and crushes further portions of the material members. This process may continue until the loading chute 48 is free of material members and portions thereof.

Each movement of the ram may be prompted by one or more user actions at the control system. For example, in at least one embodiment, the control system includes separate buttons for extending and withdrawing the ram. A user may view the contents of the loading chute through a viewing window that conveniently allows viewing into the area above the loading aperture. Thus the user may view the chopping reduction of the material members with each extension of the ram and may prompt the ram to reciprocate until the loading chute is free of material.

The control system may comprise circuits for automatically reciprocating the ram. For example, in at least one embodiment, the baler system 5 comprises a photocell sensor in electrical communication with the control system. In that embodiment, a single action by a user, namely an actuation of a control switch by a user, prompts the actuator 40 to pivot the loading member to the vertical disposition and prompts the actuator 62 to reciprocate the ram until the photocell sensor confirms that the vertical loading chute is empty. Once empty, the loading member pivots to the horizontal disposition where it can receive additional material destined for baling.

It should be understood that, as the interior of the charge box between the ram and the exit door fills with material, the ram may be prevented by crushed material from reaching the extended position 66. When this occurs, the interior of the charge box may be considered full and the crushed material may be removed from the housing through the exit door.

Several or many baling sessions such as that shown in FIGS. 4A, 4B, and 4C may occur before the charge box in considered full.

The filling of the charge box may be detected automatically and the ram may be further extended for removal of accumulated material from the housing. For example, in at least one embodiment, the baler system 5 comprises a position sensor in electrical communication with the control system. In that embodiment, the position sensor is actuated when the ram reaches the extended position such that the switch sends a signal to the control system indicating whether the ram is able to reach the extended position. If the ram fails to reach the extended position, the control system alerts the user to the filling of the charge box. For example, the control system may include a visible or audible indicator to alert the user. Furthermore, in that embodiment, the actuator 62 is capable of extending the ram beyond the extended position when the exit door 18 is opened in order to force crushed material 20 (FIG. 2) from the housing.

The actuators 24, 40 and 62 are powered by a power supply system 82 (FIG. 2). Various embodiments of a pivotally loaded baler system according to the present invention include various types of actuators and power supplies. For example, in at least one embodiment, the actuators comprise electrical motors, threaded shafts, and other mechanical linkage elements.

However, in the embodiment of the baler system 5 illustrated in FIGS. 1-3, the actuators 24 (FIG. 2), 40, and 62 (FIG. 4B) comprise pistons movable within respective cylinders and shafts that extend from, and withdraw partially within, the cylinders with movements of the pistons. The power supply system 82 comprises a fluid pump, an electric motor that motivates the pump, and a fluid manifold system that includes fluid conduit lines and solenoid actuated valves. Under the control of the control system 26, the fluid manifold system disposes the fluid pump into fluid communication with the actuators 24, 40, and 62 according to the dispositions of the valves. The fluid manifold system includes a pressure relief apparatus that permits pressurized fluid to by-pass the actuators when a piston is fully extended or withdrawn in order to prevent high pressures from damaging the actuators and components of the power supply system 82, which high pressures might otherwise develop as the pump is operated while the pistons are arrested.

Another embodiment of a pivotally loaded baler system 105 is illustrated in FIG. 5. The baler system 105 comprises a housing 110 that defines a charge box 112 in which material can be loaded, crushed by extension of a ram 160 motivated by an actuator 162, and baled. The loading of the charge box, and the crushing and severing of long members of material can be understood in view of FIGS. 4A-4C due to many structural and operational similarities between the baler system 5 shown in FIGS. 1-4C and the baler system 105 shown in FIG. 5. Differences among these two embodiments generally reside above the housings. For example, while the baler system 5 (FIGS. 1-4C) includes a loading member 30 and side walls 42 and 44 connected thereto, the baler system 105 includes a loading tube 130.

The loading tube 130 is pivotally connected to the housing 110 for loading material into the charge box 112 through the loading aperture 114 defined in an upper portion of the housing. The loading tube is pivotable from a horizontal disposition 132 to a vertical disposition 134. Material destined to be baled is placed into the loading tube when the loading tube is in the horizontal disposition. The loading tube is then pivoted to the vertical disposition to permit the material to fall toward the loading aperture. The loading tube is motivated by an actuator to assume the horizontal and vertical dispositions. The loading tube has a proximal end 152 pivotally connected to the housing and an opposing distal end 153 that travels along an arc as the loading tube is pivoted. The proximal and distal ends 152 and 153 are open to permit passage of material into and from the loading tube. When the loading tube is disposed in the vertical disposition 134, the loading tube surrounds a vertical axis 150 and the proximal and distal ends 152 and 153 align with the loading aperture of the housing.

The cage 184 of the baler system 105 is disposed at least partially about the loading tube for the safety of operators. For example, an operator standing proximal the control system 126 is prevented by the cage from being injured by the pivoting loading tube. A safety door 158 pivotally connected to the cage can be manually opened to allow passage of material into the cage when the loading tube is disposed in the horizontal disposition. Advantages of the safety door 158 may be understood in view of descriptions above with reference to the safety door 58 of the baler system 5. The loading tube entirely surrounds the vertical axis 150 when the vertical disposition is assumed such that material within the loading tube is prevented by the loading tube from spilling from the baler system 105. The cage 184 therefore is not illustrated to extend as high as the distal end 153 when the vertical disposition 134 is assumed by the loading tube. However, the figures are not necessarily drawn to scale and the cage 184 can extend to any desired height.

In the illustrated embodiment, the loading tube 130 comprises a continuous wall comprising four planar portions 141, 142, 143, and 144, which are vertically disposed when the loading tube is disposed in the vertical disposition. Thus, in the illustrated embodiment, the loading tube generally defines a polygonal cylinder, and more particularly defines a four-sided cylinder having a rectangular cross section. When the loading tube is disposed in the horizontal disposition, the planar portion 141 defines a loading member for placing thereon material destined for baling. It should be understood that other embodiments of a loading tube according to the present invention have other configurations. For example, in one embodiment, a loading tube has a continuous circular wall such that the loading tube defines a right circular cylinder. In another example, the loading tube comprises six planar wall portions such that a hexagonal cylinder is defined.

The loading tube may be constructed of sheet material such as sheet steel, aluminum, or other sheet metal material. A box-like frame comprising rigid members such as angle iron members or tubular metal members may be included in the construction of the loading tube to provide rigidity and durability. The members may be, for example, welded, bolted, or riveted together. The planar portions 141-144 may be portions of a single contiguous sheet formed to a tubular configuration. Alternatively, the portions may be welded together such that welded seams are formed along corners of the loading tube. Furthermore, the planar portions may each be individually connected to a box-like frame that maintains the tubular configuration.

A viewing window may be provided, for example in the planar portion 144 proximal the control system 126, so that an operator may view the interior of the loading tube and determine whether material is present therein when the vertical disposition is assumed. Additionally, a sensor system can be included in the baler system 105 to detect whether such material is present. For example, an infrared emitter and an opposing infrared detector may be disposed within the loading tube for detecting whether such material is present by interruption of an infrared beam. The control system 126 may comprise circuits for automatically reciprocating the ram upon a single action by a user until the sensor system confirms that the vertical loading tube is empty.

Many modifications and other embodiments of the invention set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A pivotally loaded baler system comprising:

a ram for volumetrically reducing elongate cardboard members, the ram being movable along a horizontal axis from a withdrawn position to an extended position;

a housing disposed at least partially about the ram, the housing defining a charge box into which elongate cardboard members can be loaded and in which the elongate cardboard members can be crushed and baled by movement of the ram to the extended position, the housing further defining a loading aperture above the horizontal axis for receiving elongate cardboard members into the charge box when the ram is in the withdrawn position; and a pivotable loading tube for receiving elongate cardboard members and providing the elongate cardboard members to the loading aperture, the loading tube having a first open end and a second open end opposite the first open end, the first open end pivotally connected to the housing, the loading tube being pivotable from a horizontal disposition in which the second open end is positioned for receiving elongate cardboard members therethrough, to a vertical disposition for dumping the elongate cardboard members into the charge box, wherein, when the loading tube is disposed in the vertical disposition, the loading tube surrounds a vertical axis and the first open end aligns with the loading aperture of the housing such that elongate cardboard members that are too long to enter the charge box as whole members have lower portions thereof enter the charge box while upper portions of the elongate cardboard members remain above the loading aperture surrounded by the vertical loading tube such that the members are prevented from spilling from the baler system, and wherein as the ram is moved from the withdrawn position toward the extended position, the ram severs the elongate cardboard members into separate lower portions and upper portions, the severed upper portions remaining at least temporarily above the loading aperture within the vertical loading tube while the lower portions are crushed and baled by the ram.

2. The pivotally loaded baler system of claim 1, wherein, after the upper portions of the cardboard members are severed, the severed upper portions are at least temporarily supported from below by the ram.

3. The pivotally loaded baler system of claim 1, wherein the loading tube comprises planar members that are vertically disposed when the loading tube is disposed in the vertical disposition.

4. The pivotally loaded baler system of claim 3, wherein the loading tube defines a polygonal cylinder.

5. The pivotally loaded baler system claim 3, wherein the loading tube has a rectangular cross section.

* * * * *